United States Patent [19]

Dadák et al.

[11] 4,085,777

[45] Apr. 25, 1978

[54] ARRANGEMENT FOR THE CONTROL OF WEFT INTRODUCED INTO LOOMS

[75] Inventors: Zdenek Dadák, Brno; Jaroslav Janda, Ceska u Brna; Karel Kakač, Brno, all of Czechoslovakia

[73] Assignee: Vyzkumny a vyvojovy ustav Zavodu vseobecneho strojirenstvi, Brno, Czechoslovakia

[21] Appl. No.: 762,589

[22] Filed: Jan. 26, 1977

Related U.S. Application Data

[63] Continuation-in-part of Ser. No. 680,681, Apr. 27, 1976, abandoned, which is a continuation of Ser. No. 491,318, Jul. 24, 1974, abandoned.

[30] Foreign Application Priority Data

Jul. 24, 1973 Czechoslovakia ..... 5267/73

[51] Int. Cl.[2] ..... D03D 51/34

[52] U.S. Cl. ..... 139/370.2; 139/188 R

[58] Field of Search ..... 139/370.1, 370.2, 435, 139/436, 188 R

[56] References Cited

U.S. PATENT DOCUMENTS

| | | | |
|---|---|---|---|
| 2,744,545 | 5/1956 | Taylor et al. | 139/370.2 |
| 3,424,206 | 1/1969 | Rambouser et al. | 139/188 R |
| 3,532,138 | 9/1968 | Schlappi | 139/370.2 |
| 3,590,882 | 7/1971 | Pfarrwaller | 139/370.2 |
| 3,608,590 | 9/1971 | Mohener | 139/370.2 |
| 3,742,973 | 7/1973 | Kakac | 139/435 |
| 3,821,972 | 7/1974 | Svaty et al. | 139/435 |

FOREIGN PATENT DOCUMENTS

| | | | |
|---|---|---|---|
| 2,059,270 | 6/1972 | Germany | 139/370.2 |
| 2,105,559 | 8/1972 | Germany | 139/370.2 |
| 459,098 | 8/1968 | Switzerland | 139/436 |
| 485,055 | 3/1970 | Switzerland | 139/370.2 |
| 1,269,356 | 4/1972 | United Kingdom | 139/370.2 |

*Primary Examiner*—James Kee Chi

[57] ABSTRACT

A novel construction of a control plate inserted within and corresponding to a system of plates of a picking comb of a fluid-jet loom is described. The exit opening of the control plate has a detecting section including a light source and a photocell disposed in aligned spaced relation on opposite sides of the exit slot. The width of the exit slot is narrowed, at the location of the source and photocell, to a dimension substantially equal to the diameter of the weft thread exiting from the picking space of the control plate. At least one of the light source and photocell projects into the narrow exit slot to assure an enhanced wiping action of the weft thread on the detecting elements as the weft thread moves through the exit slot.

1 Claim, 5 Drawing Figures

ARRANGEMENT FOR THE CONTROL OF WEFT INTRODUCED INTO LOOMS

CROSS-REFERENCE TO RELATED APPLICATIONS

This application is a continuation-in-part of copending application Ser. No. 680,681, filed Apr. 27, 1976, which in turn is a continuation of application Ser. No. 491,318, filed July 24, 1974. Both of the above-identified applications are now abandoned.

BACKGROUND OF THE INVENTION

The invention relates to fluid-jet looms, and more particularly to arrangements in such looms for controlling the introduction of a weft thread from a system of plates of a picking comb into the loom shed.

One typical arrangement of this type is disclosed in German published application No. 2,105,559, having a publication date of Aug. 10, 1972. A control plate is inserted into a system of plates of the loom picking comb. Illustratively, the control plate has a pair of opposed arms that define a picking opening therebetween, and a narrow exit slot communicating with the picking opening for removal of the weft. A light source and a photocell are disposed on respectively opposite sides of a narrow portion of the exit slot of the control plate to define a detecting section, such section being located as close as practicable to the picking space of the control plate. At the location of the aligned light source and photocell, the narrowed exit slot of the control plate is made substantially equal to the diameter of the exiting weft thread. In such design, the confronting ends of both the light source and the photocell terminate flush with, or in recessed relation to, the respective peripheral walls of the exit slot.

SUMMARY OF THE INVENTION

The present invention contemplates an improvement of the weft exit control arrangement of the general type discussed above. In particular, in contrast to the flush or recessed relation of each of the light source and photocell of the detecting section, at least one of the detecting elements projects into the associated narrowed portion of the fixed exit slot, so that during the exit of the weft thread through the fixed slot, the weft will execute an enhanced wiping action on the detecting elements.

Such wiping action has been found to be advantageous in maintaining optimum efficiency of the detecting section, particularly in the normal dusty surroundings of the associated air-jet loom; in particular, the wiping action maintains the effective surfaces of the detecting section free of the ambient dust that would normally collect thereon.

BRIEF DESCRIPTION OF THE DRAWING

Exemplary embodiments of the object of the invention are shown in the attached drawings, wherein.

DETAILED DESCRIPTION

Figure 3:
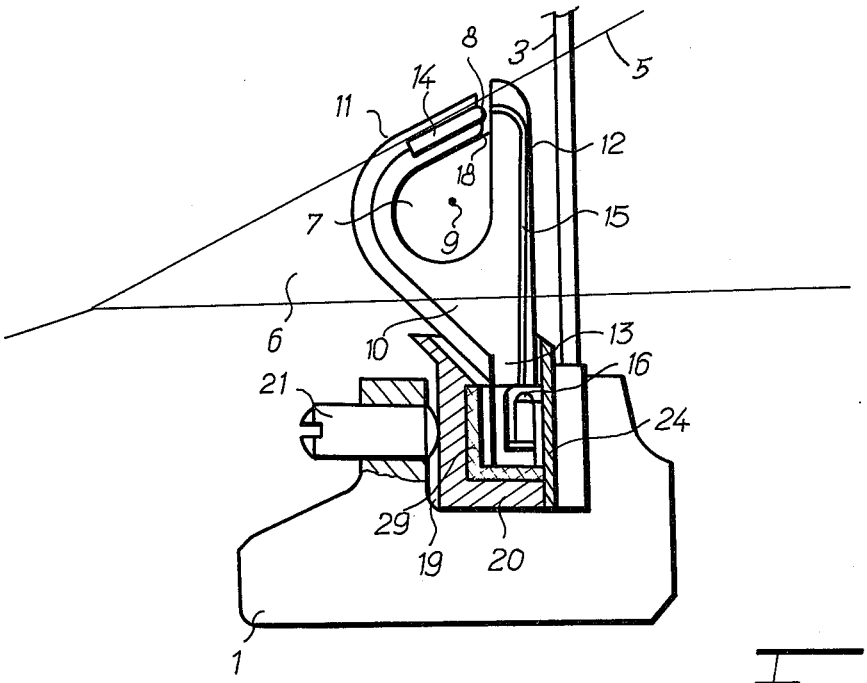
FIG. 3 shows an exemplary embodiment of the control section of the picking comb in a partly cross-sectional view.

A picking comb 2 with a reed 3 is supported by the slay 1 of a weaving machine, the slay, reed, and comb performing an oscillating movement. The picking comb 2 is composed of a system of plates 4 which at the picking moment are engaged into the shed 6 formed by opened weft threads 5 (FIG. 3). Each plate 4 has a picking opening 7 and a slot 8 for the removal of the weft thread. In the case of pneumatic picking, the picking opening 7 has a profile adapted for causing the stream of the medium taking along the weft thread to flow in a straight path. A control plate 10, controlling the removal of the weft 9 through a slot 8' corresponding to slots 8 of the plates 4, is inserted into the system of plates 4 of the picking comb 2 at a location where this control should be accomplished. In order to ensure a reliable operation thereof, this control plate 10 should be situated at a place on the picking comb 2 where at the picking moment it engages between the warp threads 5 of the shed 6. The shape of the control plate 10 corresponds substantially to the shape of the remaining plates 4 of the picking comb 2 in order to be able to penetrate into the shed 6 by a smooth pushing apart of the warp threads 5.

Figure 1:
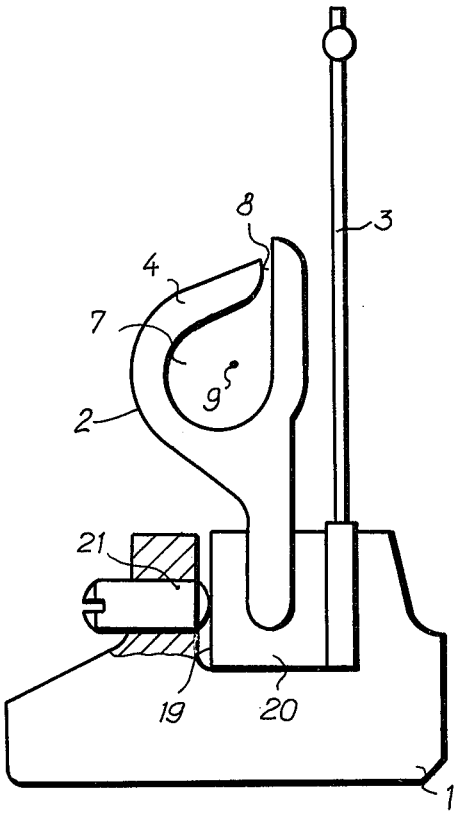
FIG. 1 is a cross-sectional view of a part of the picking comb.
Figure 2:
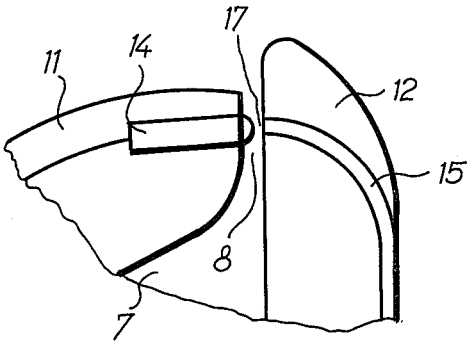
FIG. 2 is a detailed view of the slot for the removal of the weft thread of a control plate.

The control plate 10 comprises in addition to its supporting part 13 two opposed arms 11, 12. The detection means, i.e., a receiver of the detection signal, for instance a photocell 14, is situated on one of these arms 11 of the control plate 10 and a source of the detecting signal, for instance a light guide 15 such as a curved rod or fiber made of acrylic resin such as "Lucite," is situated together with the light source 16 at the incoming edge of the other arm 12 of the control plate 10. The light source 16 is cushioned and supported adjustably with respect to the inlet end of the light guide 15. At least one of the elements 14 and 15 (illustratively the photocell 14) projects into the slot 8' as shown best in FIG. 2, while the other of the elements 14 and 15 may either project into the slot, or, as shown in FIG. 2, terminate flush with it. As indicated below, the position of the detecting section 17 in the slot 8' for removal of the weft thread is important for a reliable indication, and thus also for the control of whether the weft has been correctly introduced into the shed. It is necessary to have the detecting section 17 at least on the borders of the picking space of the control plate 10. The picking spaces can comprise not only the picking opening 7' of the control plate 10, but also a part of the length of the slot 8' for the removal of the weft thread. This is due to the fact that the track of the introduced weft 9 passes not only along the axis of picking openings 7 of the picking comb 2 composed of plates, but through the whole space of picking openings 7 and through a part of their slots 8 for the removal of the weft thread.

The picking openings 7, or the slots 8 for the removal of the weft thread, may be closed by an easily deformable diaphragm 18 (see FIG. 3), the detecting section 17 of the slot 8 of the control plate 10 for the removal of the weft then being situated behind this diaphragm 18. When the slots 8 of the plates 4 of the picking comb 2 for removal of the weft thread are closed by the warp threads 5 of the shed 6, the detecting section 17 is situated behind the plane of these warp threads 5. It is, however, sufficient if the detecting section 17 is situated behind the warp threads 5 closing the slot 8' for removal of the weft of at least the control plate 10.

This is achieved if the warp threads 5 do not close the slots 8 of the plates 4 of the picking comb 2 and if the slot 8' of the control plate 10 for removal of the weft is prolonged. It is equally advantageous to reduce the width of the slot 8' of the control plate 10 for removal of the weft at the detecting section 17 but only to a minimum equal to the diameter of the controlled weft thread 9 in order to enable its removal. Because of the projection of the photocell 14 into the reduced-width portion of the slot 8', the exiting weft thread 9 will exert a positive wiping action of a frictional nature on each of the elements of the detecting section 17. The detecting section 17 thus remains constantly clean without dust or fibers, and consequently does not cause the generation of wrong signals.

Picking combs 2, particularly in looms of larger width may be divided into sections and arranged on the slay 1 of the loom. The plates 4 of each section of the picking comb 2 are fixed on a bar 20, for instance by glueing. The bars 20, with the plates 4 together with the reed 3, are mounted in a groove 19 of the slay and secured thereto by screws 21.

Figure 4:
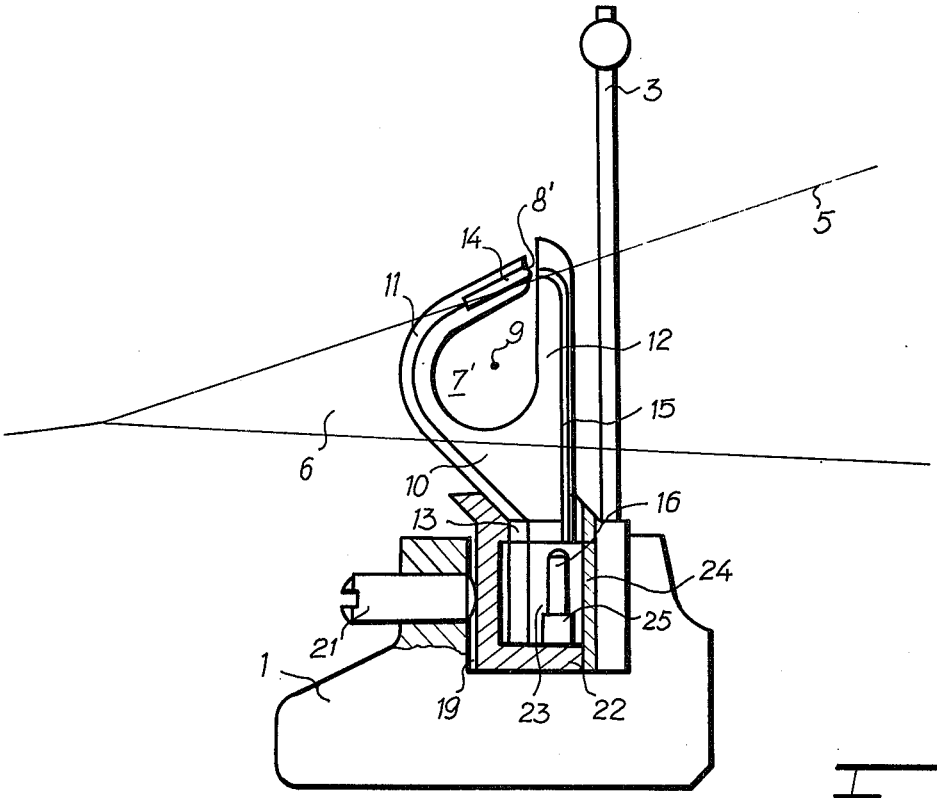
FIG. 4 is a similar view of another exemplary embodiment.

The arrangement for the control of the introduced weft 9 represents advantageously an independent control section of the picking comb 2 (see FIGS. 3 and 4), fixed on the required control place of the introduced weft by means common to that for fixing the sections of the picking comb 2 and of the reed 3, i.e., in the groove 19 of the slay and secured thereto by screws 21.

The arrangement for the control of the introduced weft 9 represents advantageously an independent control section of the picking comb 2 (see FIGS. 3 and 4), fixed on the required control place of the introduced weft by means common to that for fixing the sections of the picking comb 2 and of the reed 3, i.e., in the groove 19 of the slay 1 and secured by screws 21.

The control plate 10 together with other plates 4 is fixed on a body 22 of the control section of the picking comb 2. The body 22 corresponds by its external shape to the shape of the bar 20. It is, however, provided with a recess 23, which can be closed by a removable cover 24. A light source 16 fixed on a bearing plate 25 (FIG. 4), which can be advantageously of resilient material in order to cushion the light source 16 from the shocks of the slay 1, is arranged in this recess 23. The cushioning of the light source 16 substantially increases its operating life.

Figure 5:
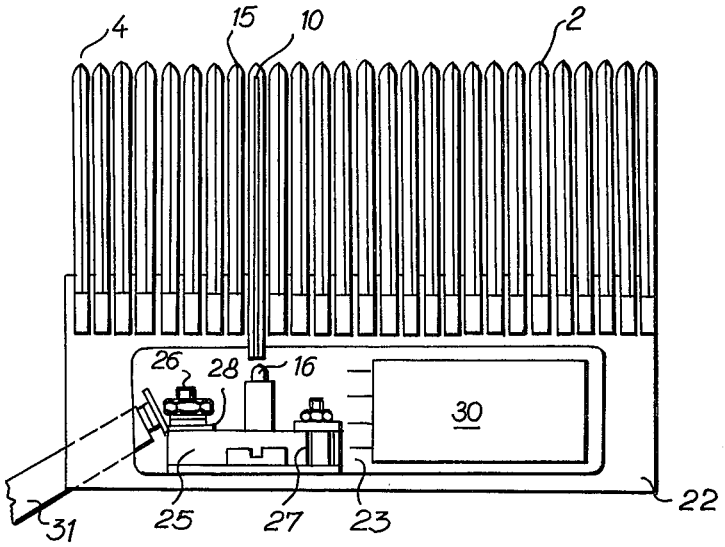
FIG. 5 is a front view of the control section shown in FIG. 3.

As shown in FIG. 3, the cushioning of the light source 16 can be also achieved if the control plate 10 is resiliently supported in the body 22 of the control section. In this embodiment, the supporting part 13 of the control plate 10 is supported in the body 22 of the control section by means of an elastic insert 29. The light source 16 is here fixed on the supporting part 13 of the control plate 10. Thus, there is achieved not only the cushioning of the light source 16, but also the cushioning of the detecting means, particularly of the photocell 14. The bearing plate 25 of the light source 16 is fixed to the body 22 of the control section of the picking comb 2 by screws 26. The openings 27 of the bearing plate 25 of the light source, through which the fixing screws 26 pass, are provided with an increased play. That enables a lateral adjustment of the position of the light source 16 with respect to the inlet end of the light guide 15. The adjustment of the height of the light source 16 is accomplished by inserts or shims 28 (FIG. 5).

A simple electronic device for processing the signal from the detecting means can be alternatively also provided in the recess 23 of the body 22. The control section of the picking comb 2 is connected by a cable 31 with an evaluating and operating part, situated on a frame (not shown) of the loom. The cable 31 serves both for the transmission of the control signal for evaluation and for the supplying of electric power to the control section.

The apparatus of the invention operates as follows: In the course of the movement of the slay 1 into the picking position, the plates of the picking comb 2 together with the control section penetrate into the shed 6 and take their position for the introduction of the weft 9. The weft 9 is introduced in a known way through the picking openings 7 of the plates 4 of the picking comb 2 and through the picking opening 7' of the control plate 10. When the slay 1 starts its movement into its beating position, the system of plates 4 and the control plate 10 are removed from the shed 6. Due to the action of the lower warp threads 5 of the shed 6, the introduced weft is forced through the slots 8 for the removal of the weft. The weft 9 introduced through the control plate 10 is forced to pass through the slot 8' of the control plate 10, and in the course of its passage through the detecting section 17, causes a change of the light flux to the photocell 14.

This signal is processed by the electronic device 30 and is transmitted via the cable 31 to the evaluating device. If the weft 9 has not passed through the detecting section 17 of the slot 8' for the removal of the weft of the control plate 10, the loom is stopped.

The arrangement for the control of the introduced weft according to this invention is obviously not limited to the described embodiments, it can be applied at all looms wherein the weft is introduced into the shed by a stream of a fluid take-up medium, by clamps and the like, guided by a picking comb.

Although the invention is illustrated and described with reference to a plurality of preferred embodiments thereof, it is to be expressly understood that it is in no way limited to the disclosure of such a plurality of embodiments, but is capable of numerous modifications within the scope of the appended claims.

What is claimed is:

1. In an arrangement for controlling the introduction of a weft thread from a picking comb composed of a system of plates into a shed in a loom, the plates of the picking comb each having a picking opening and a slot for the removal of the weft thread, the arrangement comprising a control plate having opposed arms defining a picking opening and a fixed slot for the removal of the weft, the fixed slot communicating with the picking opening in the control plate, the control plate substantially corresponding in shape to the shape of the plates of the picking comb for insertion at a desired point of the comb, a light source and a photocell individually disposed in aligned spaced relation at opposite sides of the fixed slot adjacent the picking space of the control plate, the fixed slot being narrowed to a dimension substantially equal to the diameter of the weft thread at the location of the respective light source and photocell, the improvement wherein at least one of the light source and photocell projects into the fixed slot, whereby an exit of the weft thread through the fixed slot exerts a positive wiping action on the said one of the light source and photocell which projects into the fixed slot.

* * * * *